US009124016B2

(12) United States Patent
Omori et al.

(10) Patent No.: US 9,124,016 B2
(45) Date of Patent: Sep. 1, 2015

(54) CONNECTOR WITH COVERING WALL

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Yasuo Omori, Yokkaichi (JP); Masaaki Tabata, Yokkaichi (JP)

(73) Assignees: AutoNetworks Technologies, Ltd. (JP); Sumitomo Wiring Systems, Ltd. (JP); SUMITOMO ELECTRIC INDUSTRIES, LTD. (JP)

( * ) Notice: Subject to any disclaimer, the term of this patent is extended or adjusted under 35 U.S.C. 154(b) by 0 days.

(21) Appl. No.: 14/227,139

(22) Filed: Mar. 27, 2014

(65) Prior Publication Data

US 2014/0295708 A1 Oct. 2, 2014

(30) Foreign Application Priority Data

Mar. 28, 2013 (JP) ..... 2013-068467

(51) Int. Cl.

| | |
|---|---|
| ***H01R 31/08*** | (2006.01) |
| ***H01R 13/422*** | (2006.01) |
| ***H01R 13/506*** | (2006.01) |
| ***H01R 13/52*** | (2006.01) |

(52) U.S. Cl.

CPC ..... *H01R 13/422* (2013.01); *H01R 13/506* (2013.01); *H01R 13/5205* (2013.01)

(58) Field of Classification Search

CPC ..... H01R 31/08
USPC ..... 439/507, 701, 752
See application file for complete search history.

(56) References Cited

U.S. PATENT DOCUMENTS

| | | | | |
|---|---|---|---|---|
| 5,295,846 | A * | 3/1994 | Sumida et al. | 439/188 |
| 6,328,614 | B1 * | 12/2001 | Osawa | 439/752 |
| 6,500,031 | B2 * | 12/2002 | Morita et al. | 439/752 |
| 6,645,003 | B2 * | 11/2003 | Yoshida et al. | 439/507 |
| 2012/0184144 | A1 | 7/2012 | Kikuchi | |

FOREIGN PATENT DOCUMENTS

| | | |
|---|---|---|
| JP | 2012-150938 | 8/2012 |

* cited by examiner

*Primary Examiner* — Tho D Ta
(74) *Attorney, Agent, or Firm* — Gerald E. Hespos; Michael J. Porco; Matthew T. Hespos

(57) ABSTRACT

A connector includes female terminals (10), a female terminal holder (20), male terminals (32) and a male terminal holder (40). The female terminal holder (20) includes a female terminal holding portion (50), and the female terminal holding portion (50) defines cavities (55) that open out in a direction perpendicular to a terminal fitting direction and includes female terminal locks (56, 57) configured to prevent separation of the female terminals (10) by contacting the female terminals (10) in the respective cavities (55) from behind. The male terminal holder (40) includes a male terminal holding portion (41) and a female terminal restraining portion (44) to be fit to the female terminal holding portion (50) to restrain the respective female terminals (10) from an outer side.

20 Claims, 14 Drawing Sheets

CONNECTOR WITH COVERING WALL

BACKGROUND

1. Field of the Invention

The invention relates to a joint connector with female terminals and male terminals that are connected electrically to the female terminals for shorting the female terminals.

2. Description of the Related Art

Japanese Unexamined Patent Publication No. 2012-150938 discloses a joint connector with a housing and a short-circuit busbar mounted in the housing. Male terminals are formed unitarily on the busbar and project into cavities of the housing. Female terminals mounted respectively on ends of wires are inserted into the cavities and connect electrically to the male terminals of the short-circuit busbar, thereby shorting the female terminals.

The housing is formed with locking lances for locking the female terminals in the respective cavities. Each locking lance is shaped to deflect in a direction perpendicular to the inserting direction of the female terminal as the female terminal is inserted into the cavity. However, the locking lances resiliently restore to engage the female terminal fitting that has been inserted completely, thereby preventing the female terminal from coming out. In this way, the female terminal inserted into each cavity is fit to the male terminal of the busbar along the inserting direction and is locked by the locking lance in that cavity.

A force for holding the female terminal in the housing depends on a characteristic of the locking lance engaged with the female terminal in the housing. However, a sufficient force can detach the locked female terminal in some cases. In such cases, a structurally complicated retainer has been added for doubly locking the female terminal in addition to the locking lance. Therefore the overall structure of the connector becomes complicated and a significant cost increase is incurred.

A waterproof resilient member made, for example, of rubber and having a complicated shape has to be arranged at each position if fluid- or watertightness is required for each female terminal, and the structure becomes more complicated.

In view of the above, the invention aims to provide a connector that can hold each terminal with a sufficient force without requiring a resiliently deformable locking lance and a retainer for locking the terminal. The invention also relates to a joint connector capable of collectively fluid- or waterproofing each terminal by a simple structure.

SUMMARY OF THE INVENTION

The invention relates to a connector with first terminals mounted respectively to wires and a first terminal holder configured to hold the first terminals in a specified arrangement. The first terminal holder has a first terminal holding portion with cavities configured to accommodate the first terminals. Each cavity is open out at an angle to a terminal fitting direction in which the first terminals are fit to second terminals. First terminal locks prevent separation of the first terminals in a direction away from the second terminals by contacting the first terminals in the cavities from a side opposite a side to which the second terminals are fit to the first terminals. A second terminal holder collectively holds the second terminals and includes a second terminal holding portion configured to hold the respective second terminals in an arrangement so that the second terminals can fit to the respective first terminals. A first terminal restraining portion is fit to the first terminal holder to restrain the first terminals held in the first terminal holding portion from an outer side in a state where the first terminals and the second terminals are fit together.

The first terminals can be set easily while being allowed to displace toward the open side of the cavity. The first terminal restraining portion then is fit to the first terminal holder while the second terminals in the second terminal holder are fit to the respective first terminals.

The first terminal holder and the second terminal holder preferably include fitting locks that engage one another to lock the first terminal holding portion and the first terminal restraining portion together. Thus, the first terminal restraining portion maintains a state where the first terminals set in the first terminal holding portion are restrained from the outer side. The first terminal locks are held in contact with the respective first terminals restrained at the set positions from a side opposite to the second terminals. Thus, the first terminals cannot separate away from the second terminals even if deformable locking lances and a complicated retainer are not provided.

The first terminal holding portion preferably has a base wall that supports the first terminals from an inner side in a direction perpendicular to the terminal fitting direction, and the first terminal locks project out in the terminal fitting direction from the base wall. The first terminal holding portion preferably has a covering wall configured to cover rear parts of the cavities from an outer side. The first terminals may be inserted into the cavities from behind and through an inner side of the covering wall. The covering wall restrains the female terminals at rear parts of the cavities, thereby making the held state of the female terminals more stable.

The first terminal locks may have inclined surfaces inclined to enable the first terminals inserted in respective terminal insertion holes to move onto the first terminal locks along an inserting direction thereof. The inclined surfaces enable the female terminals to be set directly at predetermined female terminal holding positions where the female terminal locks contact the female terminals from behind merely by inserting the female terminals into the terminal insertion holes.

The covering wall may include flexible pieces that correspond to the respective first terminals. The flexible pieces allow the first terminals to move onto the first terminal locks by contacting the first terminals during insertion and resiliently deflecting out to suppress a lift of the first terminals by pressing the inserted first terminals inwardly with resilient forces of the flexible pieces.

The connector may further comprise a shorting portion extending in an arrangement direction of the second terminals and configured to connect the second terminals. The shorting portion and the second terminals may be part of a unitary shorting member formed of a conductive material. The second terminal holding portion holds at least the shorting portion of the shorting member so that the second terminals project from the shorting portion toward the first terminal restraining portion.

The second terminal holder may include an end wall and a peripheral wall extending from the end wall and at least partly surrounding an opening at a side opposite the end wall. The end wall may include the second terminal holding portion, and the peripheral wall may include the first terminal restraining portion.

A seal may be located behind the first terminal holding portion. The seal may be formed of a resilient material and has an outer peripheral surface to be held in close contact with an inner peripheral surface of the peripheral wall of the second terminal holder over substantially entire periphery.

The seal may include inner peripheral surfaces surrounding terminal insertion holes into which the respective first terminals and the wire connected to the first terminals are insertable, and the inner peripheral surfaces are shaped for closely contacting outer peripheral surfaces of the wires inserted into the terminal insertion holes.

The inner peripheral surface of the peripheral wall preferably includes at least one pressing portion inclined to press the first terminal at an angle to the terminal fitting direction as the first terminal holding portion is inserted into the inside of the peripheral wall. Thus, a first terminal that may be lifted up is urged to a proper set position.

The first terminals may be female terminals mounted respectively on ends of wires. The first terminal holder may be a female terminal holder configured to hold the female terminals in a predetermined arrangement. The connector also has male terminals fittable to the respective female terminals and a male terminal holder configured to collectively hold the male terminals. The female terminal holder includes a female terminal holding portion with cavities configured to hold the female terminals. The cavities open out in a direction perpendicular to a terminal fitting direction in which the female terminals and male terminals are fit together. The cavities include female terminal locks that contact the respective female terminals in the cavities from a side opposite to the male terminals to prevent separation of the female terminals from the male terminals. The male terminal holder includes a male terminal holding portion configured to hold the male terminals in an arrangement so that the male terminals can fit to the respective female terminals. A female terminal restraining portion is fit to the female terminal holding portion to restrain the female terminals held in the female terminal holding portion from an outer side in a state where the female terminals and the male terminals are fit together. The female terminal holder and the male terminal holder include fitting locks to engage each other to lock the female terminal holding portion and the female terminal restraining portion in a fitted state.

The respective female terminals can be set easily while being allowed to displace out in a direction perpendicular to the terminal fitting direction toward the open sides of the cavities of the female terminal holder. The female terminal restraining portion of the male terminal holder then is fit and locked to the female terminal holding portion of the female terminal holder while the respective male terminals are held in the male terminal holder. As a result, the female terminal restraining portion restrains the respective female terminals in the female terminal holding portion from the outer side. The female terminal locks are held in contact with the respective female terminals from a side opposite to the male terminals while the female terminals are restrained at the set positions. Thus, the female terminals cannot separate from the male terminals even though deflectable locking lances and complex retainers are not required.

Locking lances and a retainer may be provided in the connector of the invention even though they are not required. For example, the female terminal locks can be used with auxiliary locking lances that are simpler than if the female terminal fittings were locked primarily by the locking lances. This combination can prevent detachment of the female terminals more reliably.

The female terminal holding portion preferably has a base wall that supports the female terminals from an inner side in a direction perpendicular to the terminal fitting direction, and the female terminal locks project out in the terminal fitting direction from the base wall. The female terminal holding portion preferably has a covering wall configured to cover rear parts of the cavities from an outer side. The female terminals may be inserted into the cavities from behind and through an inner side of the covering wall. The covering wall restrains the female terminals at rear parts of the cavities, thereby making the held state of the female terminals more stable.

The covering wall may include flexible pieces that correspond to the respective female terminals. The flexible pieces contact the female terminals being inserted and resiliently deflect out. Resilient restoring forces of the flexible pieces press the inserted female terminals in and suppress the lift of the female terminals. The flexible pieces restrain the female terminals over a larger area and make the held state of the female terminals more stable.

The male terminals of the connector may be mounted on ends of wires similar to the female terminals described above. The connector may be mounted on a circuit board with pin-shaped male terminals mounted on the circuit board. The invention is particularly useful as a joint connector for shorting female terminals. Specifically, a shorting portion may extend in an arrangement direction of the male terminals and may be configured to connect the male terminals. The shorting portion and the male terminals may define a unitary shorting member. The male terminal holding portion holds at least the shorting portion of the shorting member so that the male terminals project from the shorting portion toward the female terminal restraining portion.

The male terminal holder may include an end wall and a peripheral wall extending from the periphery of the end wall to surround an opening at a side opposite the end wall. The end wall includes the male terminal holding portion, and the peripheral wall includes the female terminal restraining portion. The end wall and the peripheral wall of the male terminal holder define a container shape that reliably protects the shorting member including the male terminals and the female terminals accommodated therein.

The female terminal holder may include a seal located behind the female terminal holding portion so that the shorting member and the female terminals can be waterproofed reliably by a simple structure. The seal member may be formed of a resilient member and may have an outer peripheral surface to be held in close contact with an inner peripheral surface of the peripheral wall of the male terminal holder over the entire periphery. The seal can collectively waterproof the shorting member and the respective female terminals by closing an opening of the male terminal holder, i.e. an opening surrounded by an end part of the peripheral wall of the male terminal holder while confining the shorting member and the respective female terminals fit to the respective male terminals of the shorting member in the male terminal holder. Thus, moisture cannot enter into the male terminal holder along the inner peripheral surface of the peripheral wall.

The seal preferably has inner peripheral surfaces respectively surrounding terminal insertion holes into which the female terminals and the wires connected to the female terminals are insertable. The inner peripheral surfaces are shaped for closely contacting outer peripheral surfaces of the wires inserted into the terminal insertion holes. Thus, the seal also prevents the entrance of moisture along the outer peripheral surfaces of the wires and watertightness at all positions is achieved by the single seal.

If the male terminal holder includes the peripheral wall, the inner peripheral surface of the peripheral wall preferably includes a pressing portion inclined to press any outwardly lifted terminal in toward the proper set position as the terminal holding portion is inserted into the inside of the peripheral wall. Thus, the pressing portion can enhance the connection reliability of the connector by pressing the terminal to the proper set position as the terminal holding portion is inserted.

These and other features and advantages of the invention will become more apparent upon reading the following detailed description of preferred embodiments and accompanying drawings. It should be understood that even though embodiments are described separately, single features may be combined to additional embodiments.

DETAILED DESCRIPTION OF THE PREFERRED EMBODIMENTS

Figure 1:
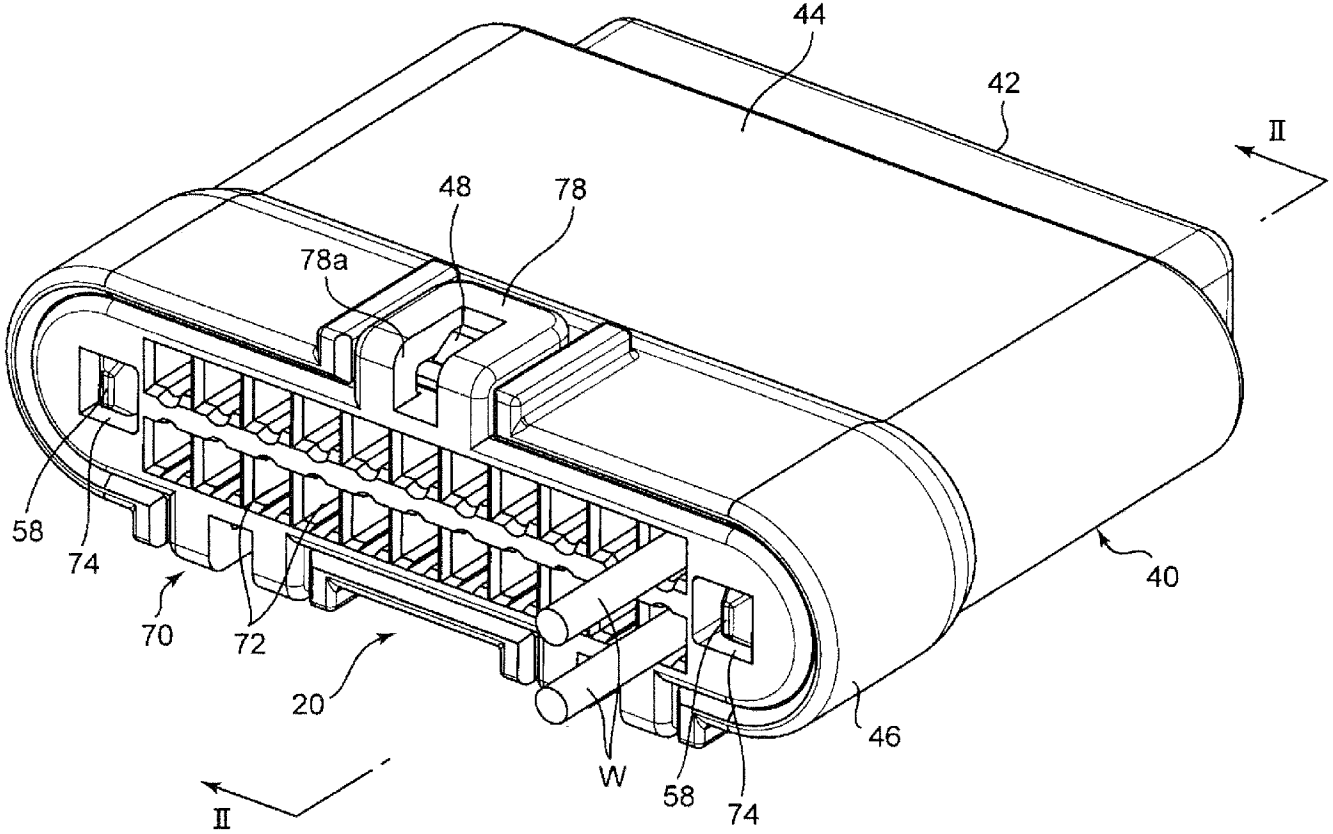
FIG. 1 is an assembled perspective view of a waterproof joint connector according to an embodiment of the present invention.
Figure 2:
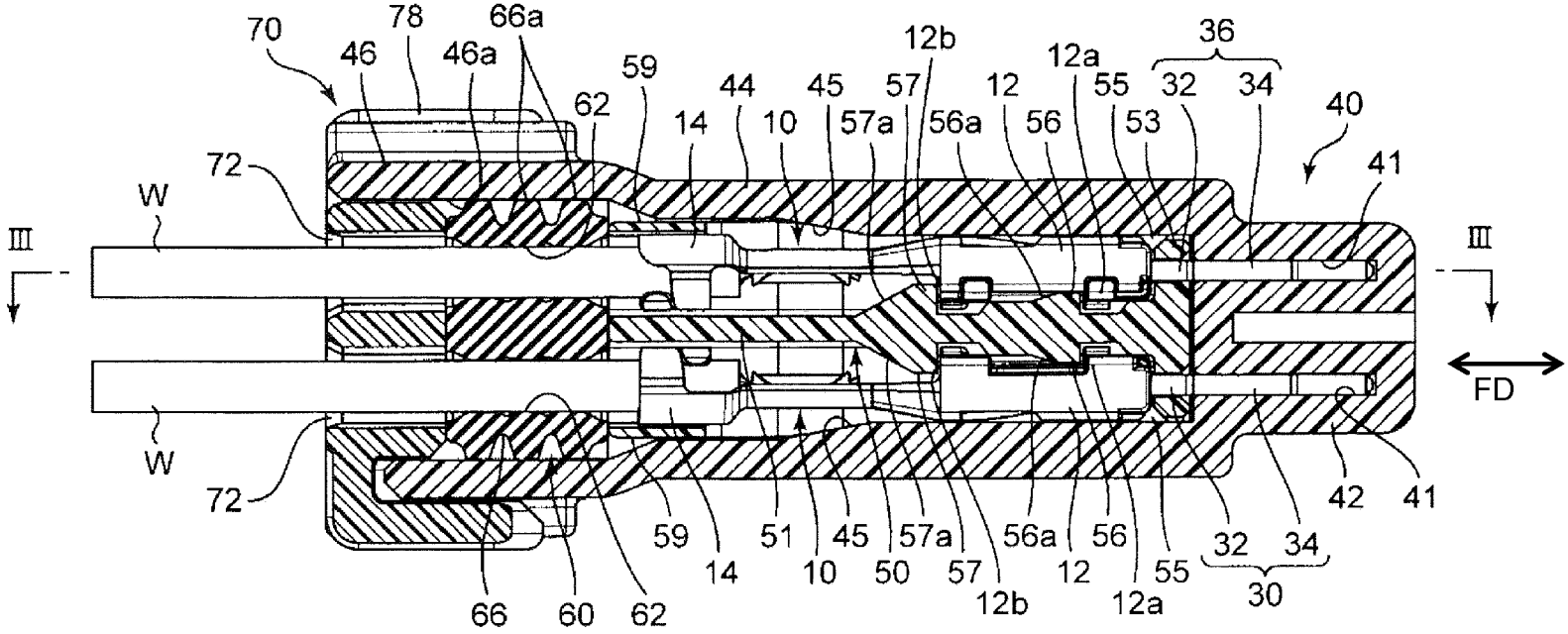
FIG. 2 is a section along II-II of FIG. 1.
Figure 3:
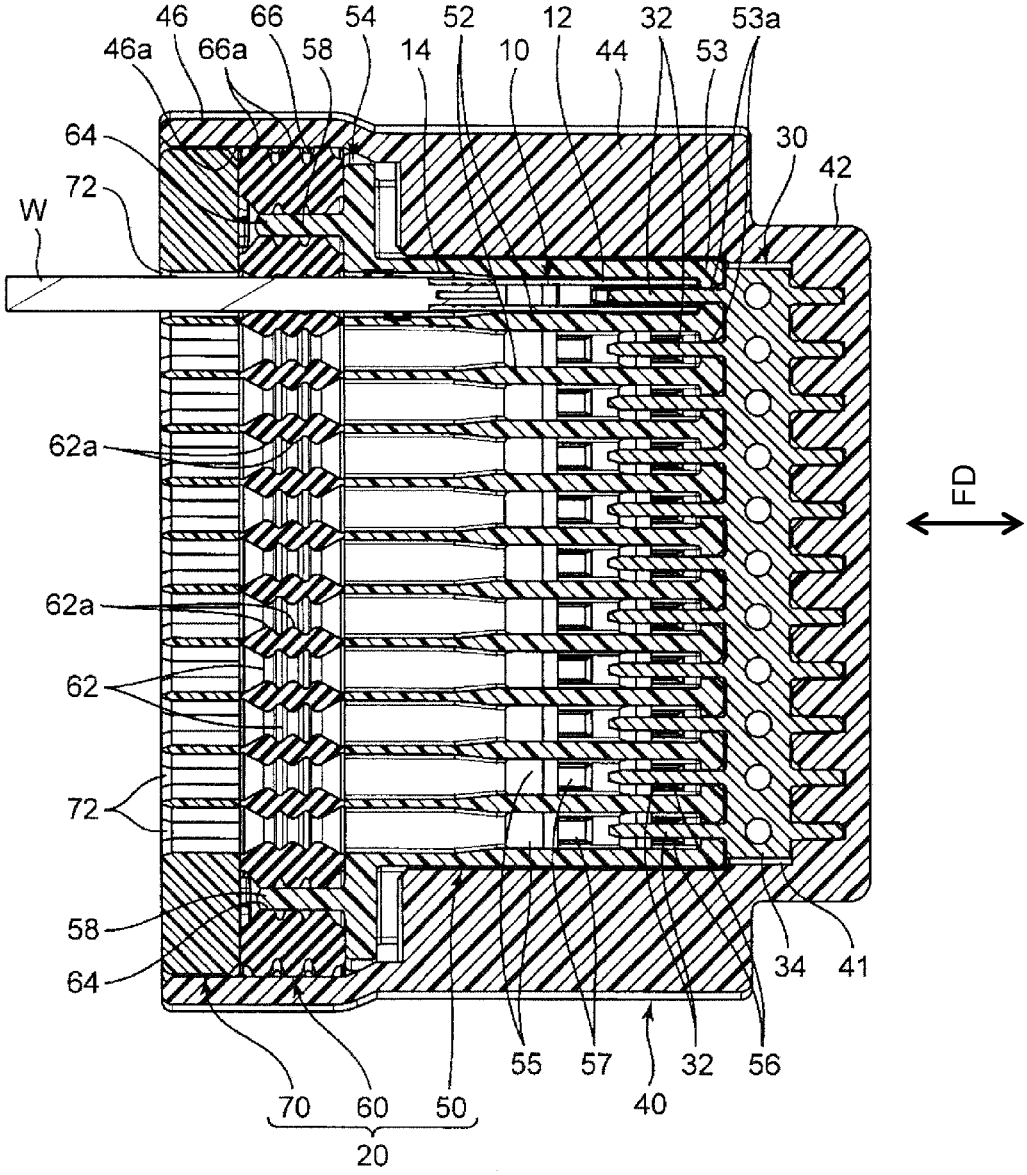
FIG. 3 is a section along III-III of FIG. 2.

FIGS. 1 to 3 show the overall configuration of the joint connector according to this embodiment. This joint connector has female terminals 10, a female terminal holder 20 for holding the female terminals 10 in a specified arrangement, shorting members 30 including male terminal portions 32 that can fit to the respective female terminals 10, and a male terminal holder 40 for holding the shorting members 30.

The female terminals 10 are mounted respectively on ends of wires W. Each wire W includes a center conductor and an insulation coating covering the center conductor and the female terminal 10 is crimped to the end of the wire E to be connected conductively to the center conductor. Specifically, the female terminal 10 is formed by bending a single unitary metal plate that includes a female electric contact portion 12 that can receive the male terminal 32 and a wire crimping portion 14 to be crimped to embrace the end of the wire W.

As also shown in FIGS. 4 to 10, the female terminal holder 20 includes a female terminal holding portion 50, a seal 60 and a back holder 70.

Figure 4:
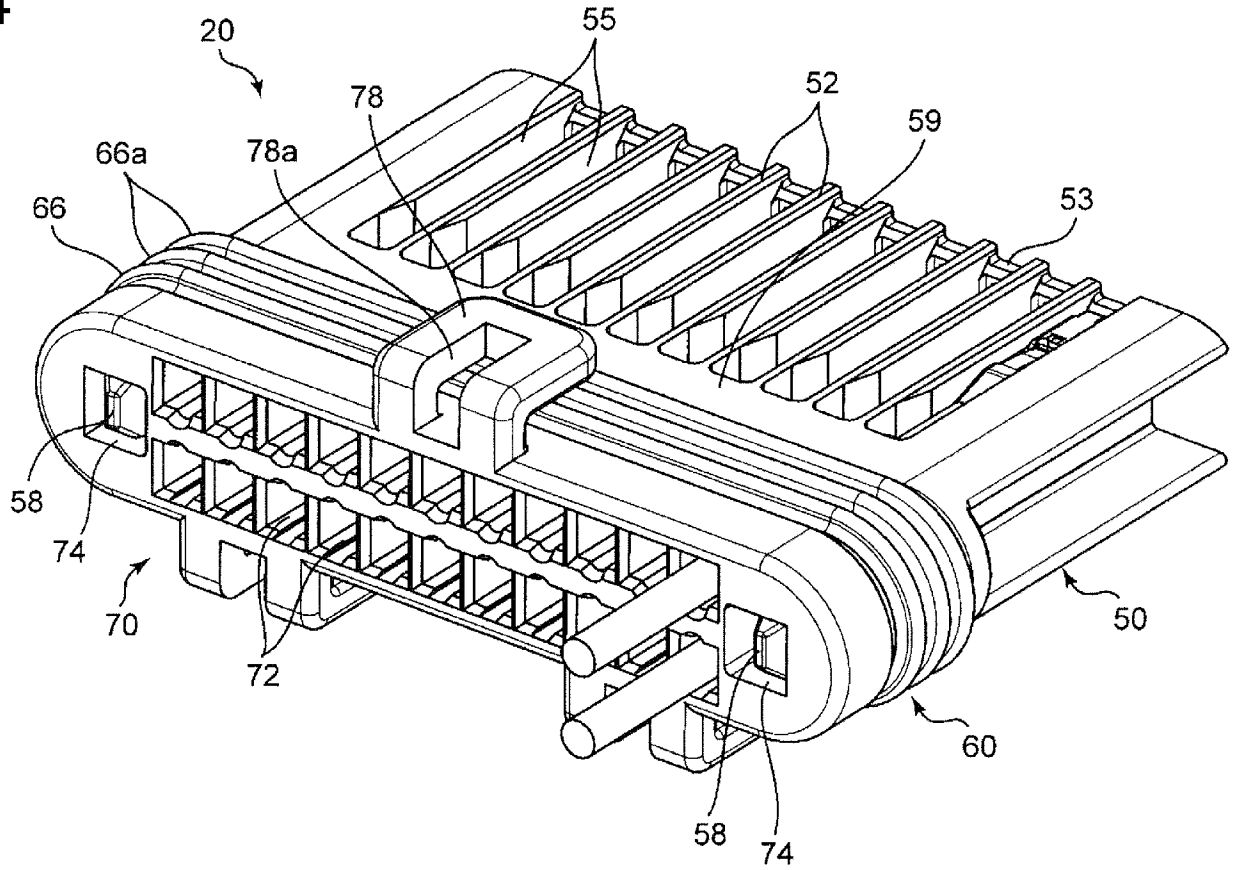
FIG. 4 is an assembled perspective view of a female terminal holder of the waterproof joint connector.
Figure 5:
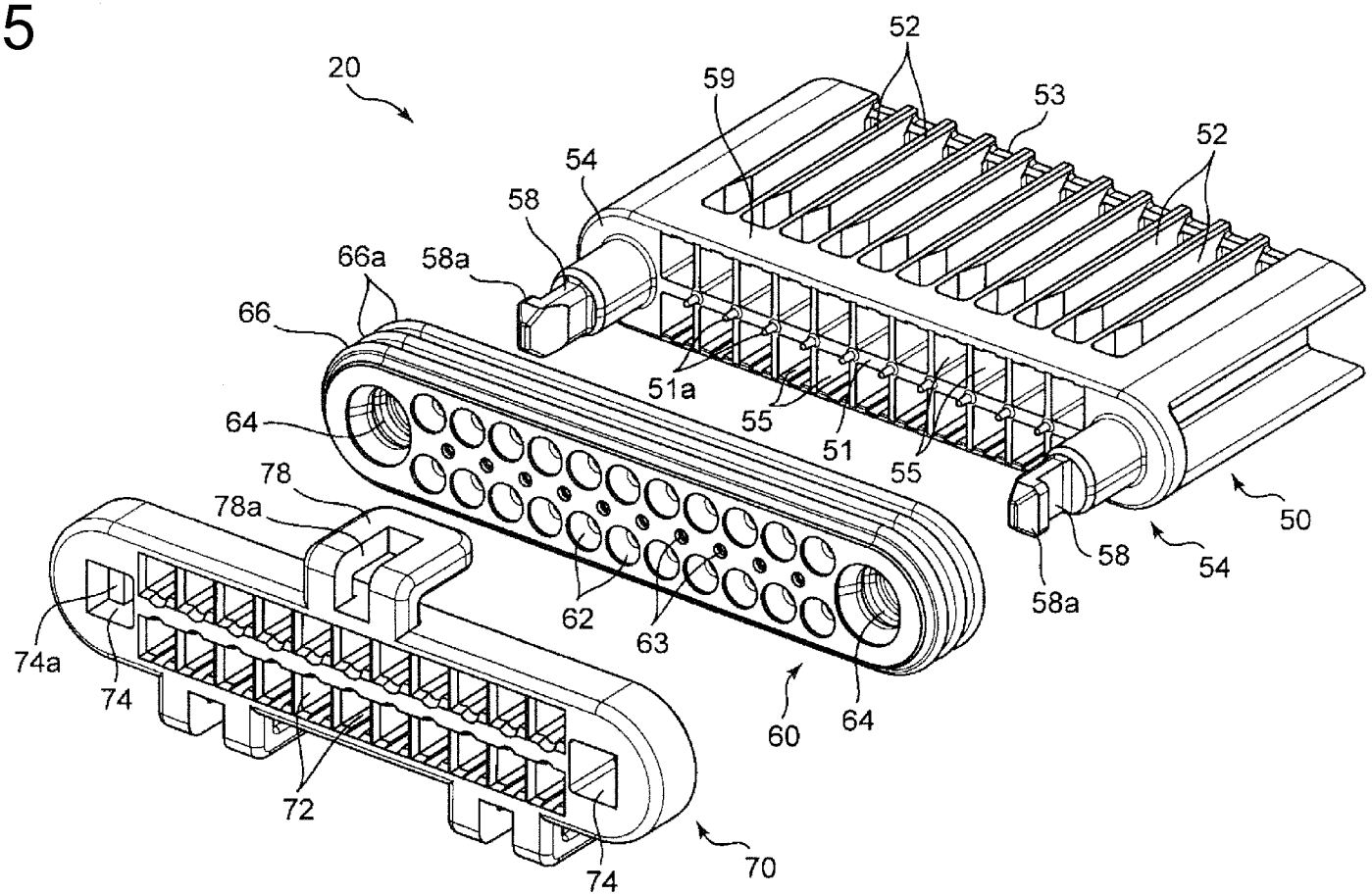
FIG. 5 is an exploded perspective view of the female terminal holder.

The female terminal holding portion 50 is for holding the respective female terminals 10 in a specified arrangement. In this embodiment, the female terminals 10 are held at arranged positions in upper and lower rows. Specifically, the female terminal holding portion 50 unitarily includes a flat plate-shaped base wall 51, partition walls 52 projecting from opposite surfaces of the base wall 51, as shown in FIGS. 1, 4 and 5, a front wall 53, covering walls 59 and a back holder coupling portion 54 provided at substantially opposite outer sides of the base wall 51.

The partition walls 52 extend in a terminal fitting direction FD in which the female terminals 10 and the corresponding male terminal portions 32 are fit together (lateral direction in FIGS. 2, 8 to 10) and cooperate with the base wall 51 to define cavities 55. Each cavity 55 is a space for individually accommodating the female terminal 10 and is open toward an outer side in a direction substantially perpendicular to the terminal fitting direction FD (side opposite the base wall 51; upper or lower side in FIGS. 2, 4, 5 and 8 to 10). Accordingly, the corresponding female terminal 10 can be set in the cavity 55 while being allowed to be displaced toward the outer side.

The front wall 53 stands upright at the front end of the base wall 51 to set the front end position of the female terminal 10 in each cavity 55. The front wall 53 is formed with through holes 53*a* corresponding to the cavities 55. The through holes 53*a* allow the male terminal portions 32 to be inserted and fit into the electric contact portions 12 of the female terminals 10 in the cavities 55.

The covering walls 59 cross the cavities 55 and cover rear end parts of the cavities 55 in each rows from the outer side, i.e. from the side opposite the base wall 51. Thus, each cavity 55 is not open in the entire area in a longitudinal direction, and the covering wall 59 covers the rear part. Thus, the female terminal 10 is inserted in each cavity 55 in a direction substantially parallel to the terminal fitting direction FD from behind.

First and second female terminal locks 56, 57 project from opposite surfaces of the base wall 51. Specifically, the first and second female terminal locks 56, 57 are formed at positions one after the other in each cavity 55 and are shaped to prevent separation of the female terminal 10 in a direction away from the male terminal portion 32 by contacting the female terminal 10 set in the cavity 55 from behind, i.e. from a side opposite to the male terminal portion 32. The first female terminal lock 56 is formed at a position to contact a part 12*a* projecting toward the base wall 51 at an intermediate position of the electric contact portion 12 of the female terminal 10, and the second female terminal lock 57 is formed at a position to contact a rear end 12*b* of the electric contact portion 12.

Figure 8:
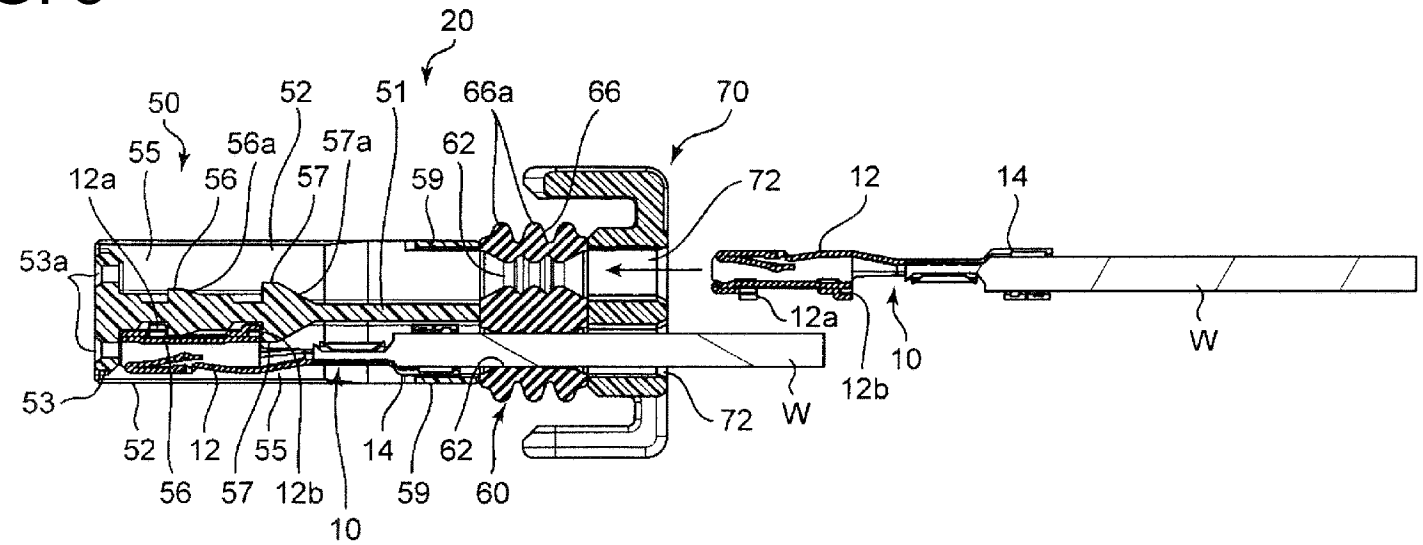
FIG. 8 is a front view in section showing a state where a female terminal is inserted into a terminal insertion hole of a seal member of the female terminal holder.
Figure 9:
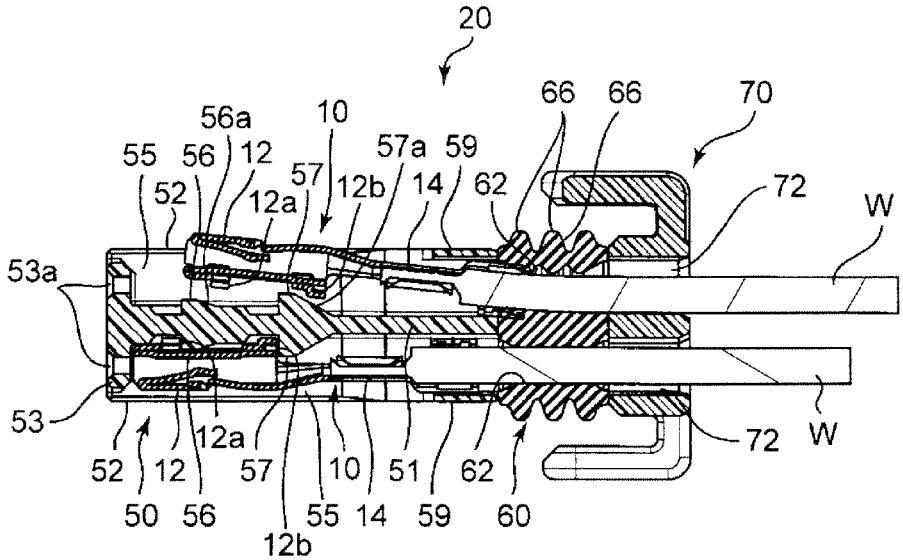
FIG. 9 is a front view in section showing a state after the female terminal is inserted into the terminal insertion hole and before the female terminal is set at a proper set position of a female terminal holding portion of the female terminal holder.
Figure 10:
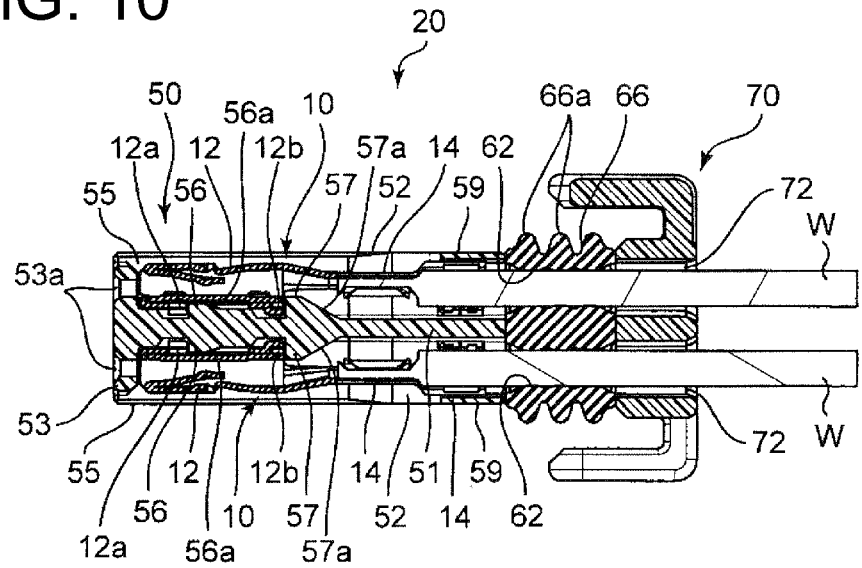
FIG. 10 is a front view in section showing a state after the female terminal is set at the proper set position.

An inclined surface 56*a*, 57*a* is formed on a rear part of each female terminal lock 56, 57, as shown in FIGS. 8 to 10. Each inclined surface 56*a*, 57*a* is sloped to project farther out at advancing positions along the inserting direction of the female terminal 10. Thus, the female terminal 10 moving parallel to the terminal fitting direction FD slides smoothly along the inclined surface 56*a*, 57*a* of the female terminal lock 56, 57 while displacing out at an angle to the terminal fitting direction FD. Each female terminal lock 56, 57 locks the properly inserted female terminal 10 from behind to hold the female terminal 10 at a specified position.

It is not always necessary to provide a plurality of female terminal locks for one female terminal 10. For example, it is also possible to omit the first female terminal lock 56 and lock the female terminal 10 only by the second female terminal lock 57.

A back holder coupling 54 includes arms 58 extending farther back than the base wall 51 and a lock 58*a* is formed near the rear end of each arm 58. The back holder 70 is coupled to the back holder coupling 54 so that the seal 60 is sandwiched between the back holder 70 and the female terminal holding portion 50.

The seal 60 is located behind the female terminal holding portion 50, i.e. at a side substantially opposite to the male terminal portions 32 and collectively fluid- or waterproofs the female terminals 10 and the shorting members 30 in cooperation with the male terminal holder 40.

The seal 60 is formed of a resilient material, such as rubber, and defines a block with terminal insertion holes 62. Each terminal insertion hole 62 is shaped so that the female terminal 10 and the wire W connected to the female terminal 10 are insertable therethrough from behind. The inner peripheral surface of each terminal insertion hole 62 is shaped to closely contact the outer peripheral surface of the wire W in the terminal insertion hole 62. Each inner peripheral surface of the seal 60 has elongated projections 62*a*, as shown in FIG. 3, that closely contact the outer peripheral surface of the wire W over the entire circumference with resilient forces while being compressed and deformed radially outward to prevent the entrance of moisture along the outer peripheral surface.

Through holes 64 are provided on opposite lateral parts of the seal 60 and penetrate the seal 60 in a front-back direction substantially parallel to the terminal fitting direction FD. The through holes 64 are shaped to allow the arms 58 of the back holder coupling 54 to be inserted therethrough from the front and the rear ends of the arms 58 to project farther back than the rear end of the seal 60.

The back holder 70 is coupled to the rear ends of the arms 58 of the back holder couplings 54 so that the seal 60 is sandwiched between the back holder 70 and the female terminal holding portion 50. This back holder 70 is formed with terminal insertion holes 72 corresponding to the terminal insertion holes 62 of the seal 60 and through holes 74 corresponding to the arms 58.

The terminal insertion holes 62, 72 are shaped to allow the female terminal 10 and the wire W connected to the female terminal 10 to be inserted therethrough from behind and into the cavities 55.

Figure 6:
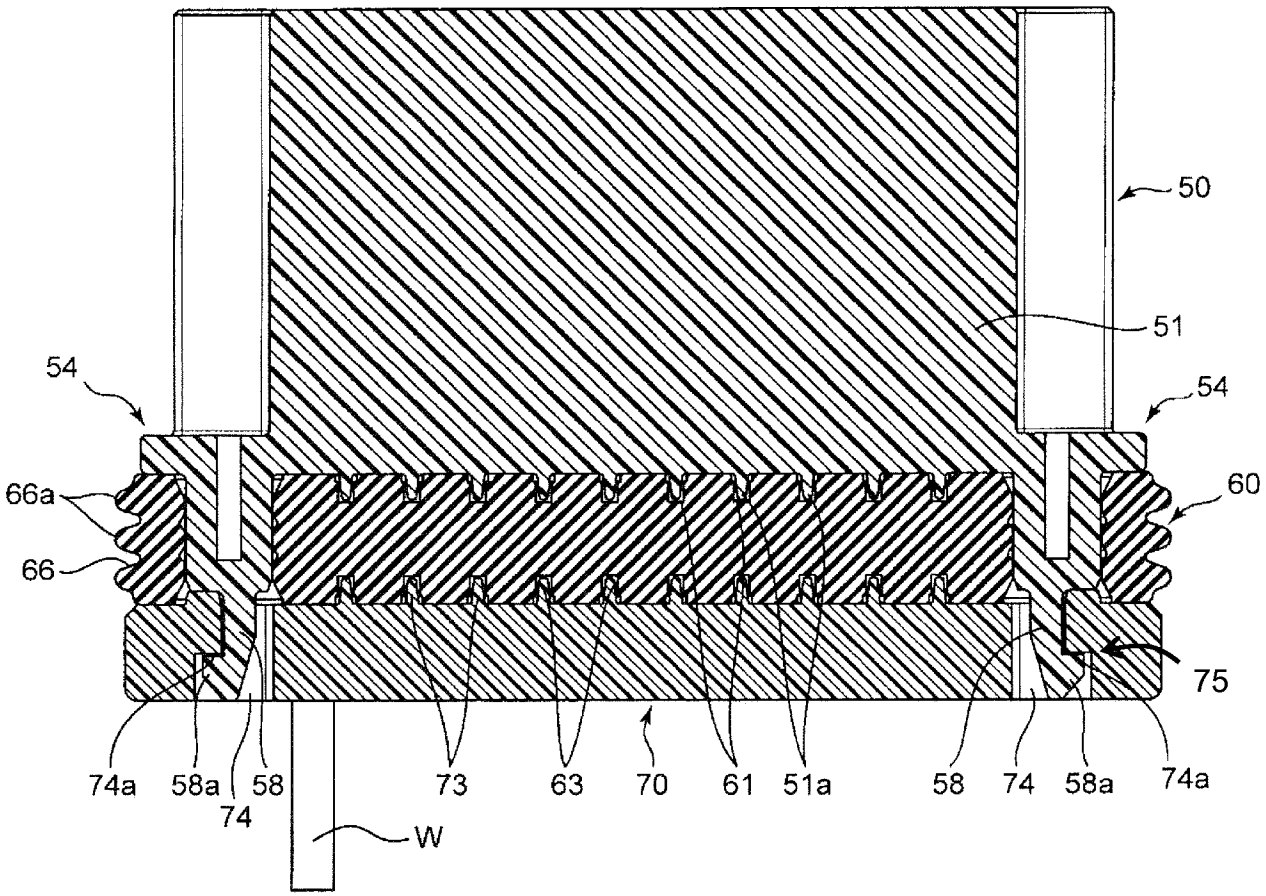
FIG. 6 is a plan view in section of the female terminal holder.
Figure 7:
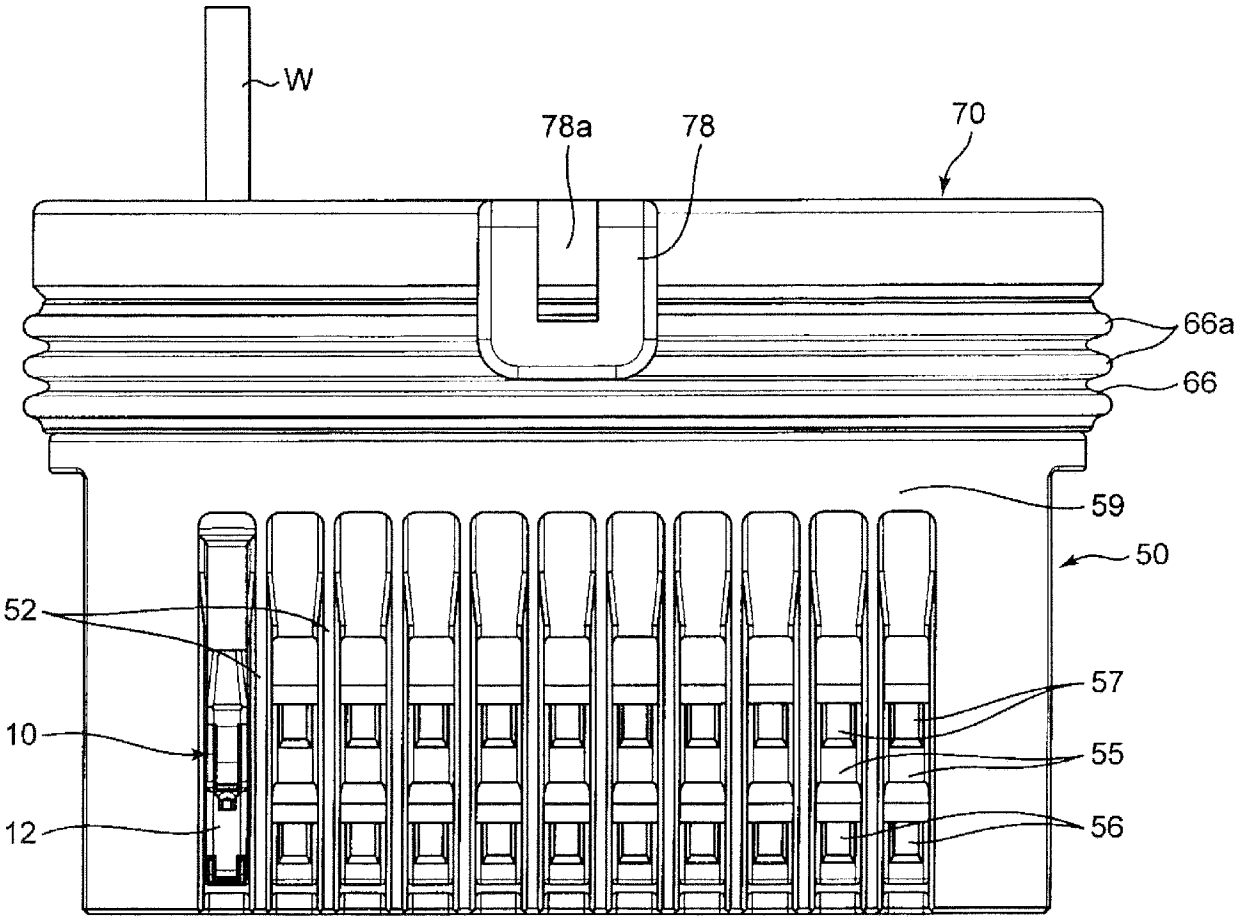
FIG. 7 is a bottom view of the female terminal holder.

A step 75 is formed in each through hole 74, as shown in FIG. 6. The steps 75 are shaped to engage the locks 58*a* of the respective arms 58 for locking the back holder 70 to the female terminal holding portion 50 with the seal 60 sandwiched between the female terminal holding portion 50 and the back holder 70.

The seal 60, the female terminal holding portion 50 and the back holder 70 have means for determining the position of the seal 60 relative to the female terminal holding portion 50 and the back holder 70. Specifically, projections 51*a*, 73 project from the rear surface of the base wall 51 of the female terminal holding portion 50 and the front end surface of the back holder 70, and holes 61, 63 are provided on opposite front and rear surfaces of the seal 60 for receiving the projections 51*a*, 73.

A rear part of the each female terminal lock 56, 57 has the inclined surface 56*a*, 57*a* that enables the female terminal 10 inserted into the terminal insertion holes 72, 62 to move onto the female terminal locks 56, 57 while being inserted into the cavity 55, as shown in FIGS. 8 to 10. Each inclined surface 56*a*, 57*a* is inclined to project farther out at positions closer to the front so that the female terminal 10 can slide smoothly along the inclined surface 56*a*, 57*a* while moving substantially parallel to the terminal fitting direction FD. Specifically, each inclined surface 56*a*, 57*a* particularly is shaped to enable the female terminal 10 to be set at the predetermined female terminal holding position where the female terminal locks 56, 57 contact the female terminal 10 from behind following insertion of the female terminal 10 into the terminal insertion holes 62, 72.

The shorting member 30 is formed unitarily of a single piece of conductive metal plate and includes the male terminal portions 32 and the shorting portion 34. The male terminal portions 32 are arranged to correspond to the arrangement of the female terminals 10 held at each of the opposite sides of the base wall 51, and the shorting portion 34 is shaped to extend in an arrangement direction of the male terminal portions 32 so as to connect the male terminal portions 32. Thus, this shorting portion 34 can electrically connect (i.e. short) the female terminals 10 fit to the respective male terminal portions 32 to each other.

The male terminal holder 40 includes an end wall 42 and a peripheral wall 44. The end wall 42 is shaped to cover the front end of the female terminal holding portion 50. The peripheral wall 44 extends from the periphery of the end wall 42 toward the female terminal holder 20 and defines a substantially elliptical tube that is long in a direction parallel to the arrangement direction of the female terminals 10. The peripheral wall 44 has a rear portion 46 that is cross-sectionally larger than other parts of the peripheral wall 44 and surrounds an opening on a side opposite the end wall 42, i.e. on a rear side.

The end wall 42 includes a male terminal holding portion for holding each shorting member 30. Specifically, the end wall 42 is formed with two holding grooves 41. The holding grooves 41 are shaped so that the shorting portions 34 of the shorting members 30 are press-fit therein from the inner space of the peripheral wall 44. Thus, the end wall 42 holds the shorting portions 34 of the shorting members 30 in an arrangement so that the respective male terminal portions 32 of the shorting members 30 project into the inner space of the peripheral wall 44 from the end wall 42 and fit to the respective female terminals 10.

The peripheral wall 44 includes a female terminal restraining portion configured to restrain the female terminals 10 from an outer side when the female terminal holding portion 50 of the female terminal holder 20 is fit therein. Thus, the female terminals 10 held in the female terminal holding portion 50 are restrained from an outer side when the female terminals 10 and the male terminal portions 32 are fit together.

Figure 11:
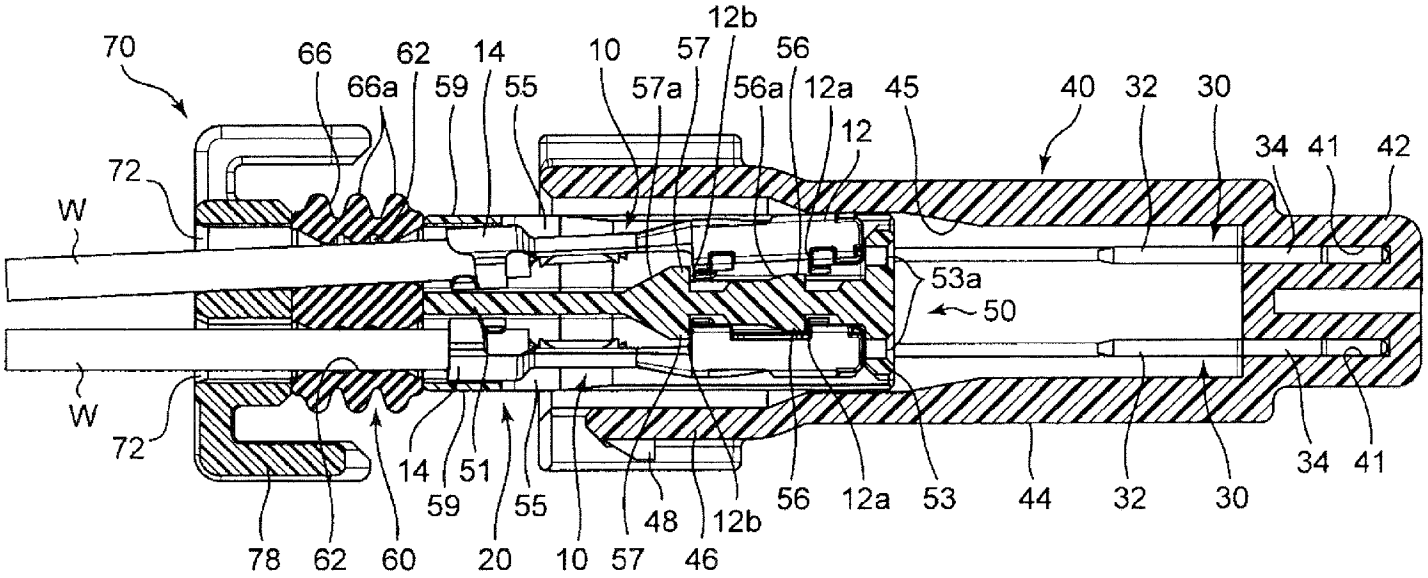
FIG. 11 is a front view in section showing a state while the female terminal holding portion of the female terminal holder is being fit into the inside of a peripheral wall of a male terminal holder and before a pressing portion on the inner side surface of the peripheral wall presses the female terminal in the female terminal holding portion in the waterproof joint connector.

The inner peripheral surface of the peripheral wall 44 has pressing portions 45 for pressing the female terminals 10. As shown in FIG. 11, each pressing portion 45 is inclined in toward the front. Thus, any female terminal 10 that is lifted out at an angle to the terminal fitting direction FD from the proper position in the cavity 55 is pressed in to the female terminal holding portion 50 to achieve the proper set position as the female terminal holding portion 50 is inserted into the peripheral wall 44.

The seal 60 has an outer peripheral surface 66 that closely contacts an inner peripheral surface 46*a* of the rear end portion 46 of the peripheral wall 44 over the substantially entire periphery. Specifically, the outer peripheral surface 66 includes elongated projections 66*a* arranged one after another in the front-back direction and extending continuously around the entire periphery. The elongated projections 66*a* are compressed resiliently inward while closely contacting the inner peripheral surface 46*a* over substantially the entire periphery with resilient forces thereof. Thus, the seal 60 can close the opening surrounded by the rear end portion 46 of the peripheral wall 44 while confining the shorting members 30 and the female terminals 10 fit to the respective male terminal portions 32 of the shorting members 30 in the male terminal holder 40.

The female terminal holder 20 and the male terminal holder 40 include fitting locks engageable with each other to lock the fitted state of the female terminal holding portion 50 and the female terminal restraining portion of the peripheral wall 44. Specifically, a lock projection 48 projects out from the outer peripheral surface of the rear end portion 46 of the peripheral wall 44 of the male terminal holder 40, and a lock arm 78 extends from the back holder 70 of the female terminal holder 20 toward the rear end portion 46. The lock arm 78 is in the form of a frame surrounding a space 78*a*, and relative positions of the lock projection 48 and the lock arm 78 are set so that the lock projection 48 is fit into the space 78*a* to be locked to the lock arm 78 when the female terminal holding portion 50 and the female terminal restraining portion are fit completely.

The female terminals 10 are set into the female terminal holding portion 50, as shown in FIGS. 8 to 10. More particularly, the female terminals 10 mounted on the ends of the wires W are inserted into the respective cavities 55 in the female terminal holding portion 50 of the female terminal holder 20. Specifically, each female terminal 10 is inserted successively into the terminal insertion hole 72 of the back holder 70 and the terminal insertion hole 62 of the seal 60 and directly into the corresponding cavity 55 from behind and inward of the covering wall 59.

Each cavity 55 is open outward in an area before the covering wall 59 and allows an outward displacement of the female terminal 10 during this insertion. Thus, the female terminal 10 moves forward while moving onto the inclined surfaces 57*a*, 56*a* on the rear sides of the respective female terminal locks 57, 56 along the inserting direction thereof and reaches the front wall 53. In this way, the female terminal 10 can be set at the proper set position where the female terminal locks 56, 57 are held in contact with the projecting part 12*a* at the intermediate position of the electric contact portion 12 and the rear end 12*b* of the electric contact portion 12.

On the other hand, each wire W connected to the female terminal 10 also is inserted into the terminal insertion hole 62 of the seal 60 and the terminal insertion hole 72 of the back holder 70. At this time, the inner peripheral surface (surface including the plurality of elongated projections 62*a* shown in FIG. 3) surrounding the terminal insertion hole 62 of the seal 60 is held in close contact with the outer peripheral surface of the wire W over substantially the entire circumference, thereby preventing the entrance of fluids and/or moisture into the connector along this outer peripheral surface.

Figure 12:
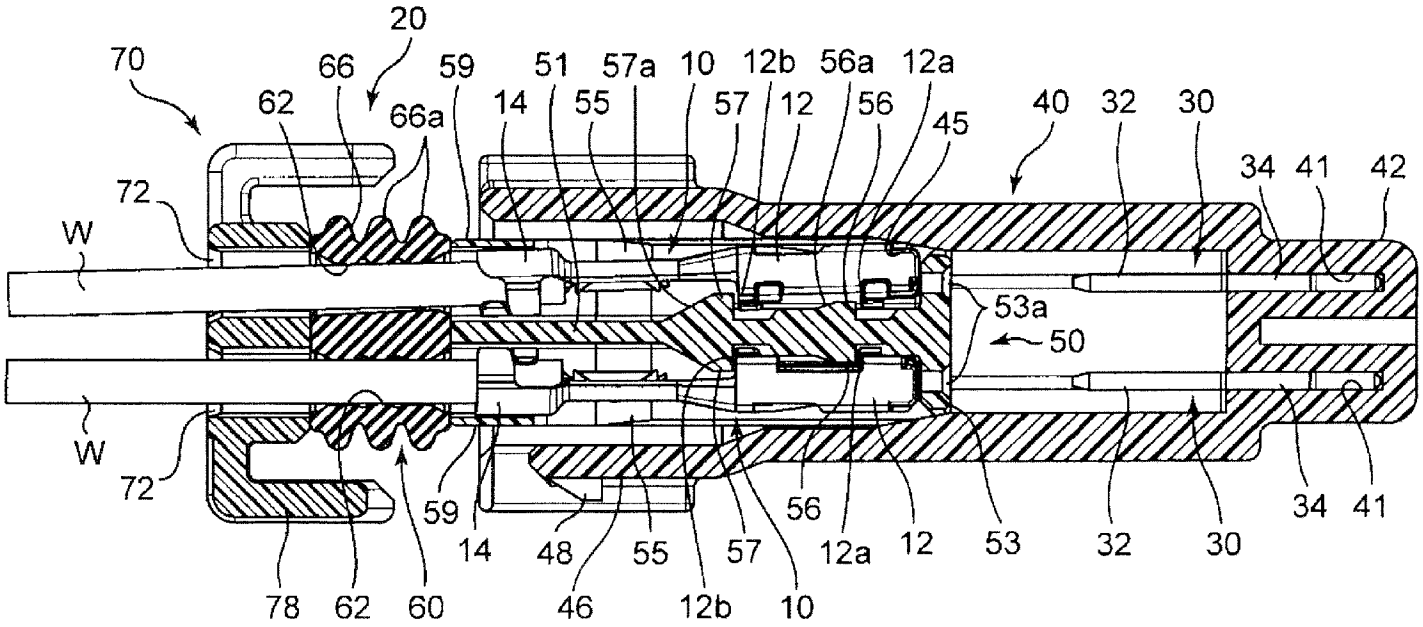
FIG. 12 is a front view in section showing a state while the female terminal holding portion of the female terminal holder is being fit into the inside of the peripheral wall of the male terminal holder and after the pressing portion on the inner side surface of the peripheral wall presses the female terminal in the female terminal holding portion in the waterproof joint connector.

The female terminals 10 and the male terminal portions 32 then are fit together, as shown in FIGS. 11 and 12. More particularly, the female terminal holding portion 50 with each female terminal 10 set in the cavity 55 as described above is fit into the inside of the peripheral wall 44 of the male terminal holder 40. Thus, the female terminals 10 and the corresponding male terminal portions 32 of the shorting members 30 held by the end wall 42 are fitted along the terminal fitting direction FD so that the female terminals 10 are shorted via the shorting members 30.

Any female terminal 10 that is lifted out from the proper set position thereof, as shown in FIG. 11, is pressed by the pressing portion 45 of the peripheral wall 44 to urge the female terminal 10 from the outer side and toward the proper set position. Accordingly, even if the fitting of the female terminal holding portion 50 and the peripheral wall 44 is started with at least some of the female terminals 10 set incompletely, the pressing portions 45 forcibly press the incompletely set female terminals 10 to the proper set positions as the fitting progresses. Therefore, proper fitting of the female terminals 10 and the corresponding male terminal portions 32 can be guaranteed and the connection reliability of the connector can be enhanced.

The lock arm 78 of the back holder 70 engages the lock projection 48 of the male terminal holder 40 as the fitting is completed, thereby locking the female terminals 10 and the male terminal portions 32 and locking the peripheral wall 44 and the female terminal holding portion 50. In this state, the peripheral wall 44 restrains the female terminals 10 from the outer sides and restricts outward displacements of the female terminals 10 to maintain the state where the respective female terminal locks 56, 57 are held in contact with the female terminals 10. This enables the respective female terminals 10 to be held without adding flexible locking lances and a complex retainer as in conventional connectors and more firmly than the locking by the locking lances and the retainer. Therefore the detachment of the female terminals 10, i.e. the separation thereof in a direction away from the male terminal portions 32 can be prevented reliably.

Conventional connectors lock female terminals with locking lances that are deflected to retract out as the female terminals are inserted. In some cases, the locking lances cannot sufficiently resist a pull-out force on the female terminals. In such cases, it is necessary to add a retainer having a complicated structure to lock the female terminals redundantly. However, each cavity 55 of the female terminal holding portion 50 is shaped to open out and to allow the female terminal 10 to displace out in the joint connector shown in FIGS. 1 to 12. Thus, the female terminal locks 56, 57 need not be deflectable and deformable like conventional locking lances. In addition, the female terminal 10 set in the cavity 55 that has the female terminal locks 56, 57 is restrained from the outer side by the peripheral wall 44 externally fit on the female terminal holding portion 50. As a result, the female terminals 10 are held engaged with the female terminal locks. Accordingly, each female terminal 10 is held in the cavity 55 by a simple structure and with a sufficient holding force. Further, the male terminal holder 40 can collectively and effectively protect the respective female terminals 10 and shorting members 30 accommodated therein.

The outer peripheral surface 66 of the seal 60 located behind the female terminal holding portion 50 closely contacts the inner peripheral surface 46*a* of the rear end portion 46 of the peripheral wall 44 over substantially the entire periphery to prevent the entrance of fluid and/or moisture along the inner peripheral surface 46*a*. Thus, the seal 60 utilizes the container shape of the male terminal holder 40 to seal the female terminals 10 and the shorting members 30 in the male terminal holder 40. As a result, the female terminals 10 and the shorting members 30 are waterproofed collectively.

The seal 60 has the inner peripheral surfaces respectively surrounding the terminal insertion holes 62. These inner peripheral surfaces are shaped to be held in close contact with the outer peripheral surfaces of the wires W connected to the respective female terminals 10 over the entire circumferences. Thus, necessary fluid- or watertightness can be achieved at all positions by the single seal member 60.

The invention is not limited to the embodiment described above and may include, for example, the following embodiments.

Figure 13:
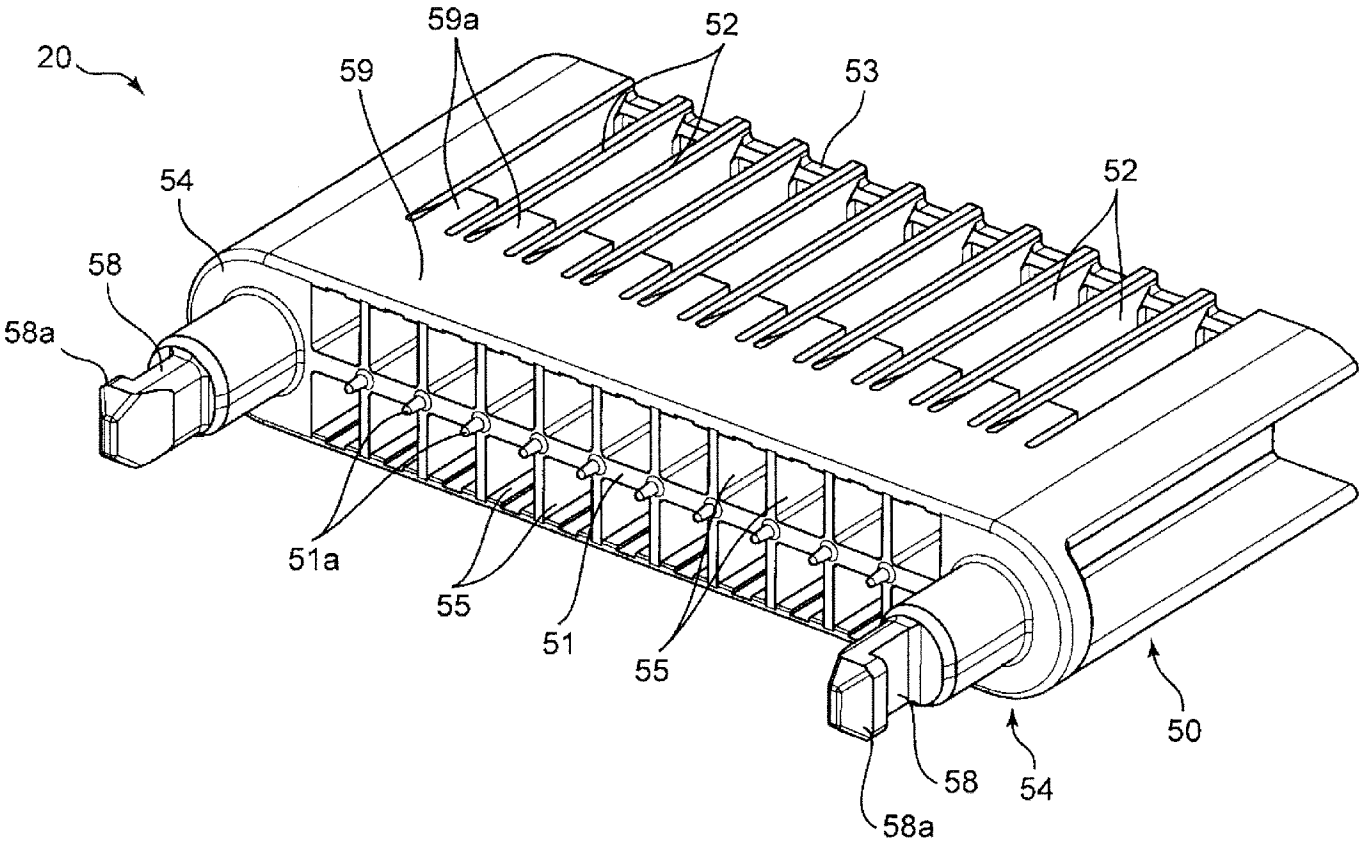
FIG. 13 is a perspective view showing a modification of the female terminal holding portion of the female terminal holder.
Figure 14:
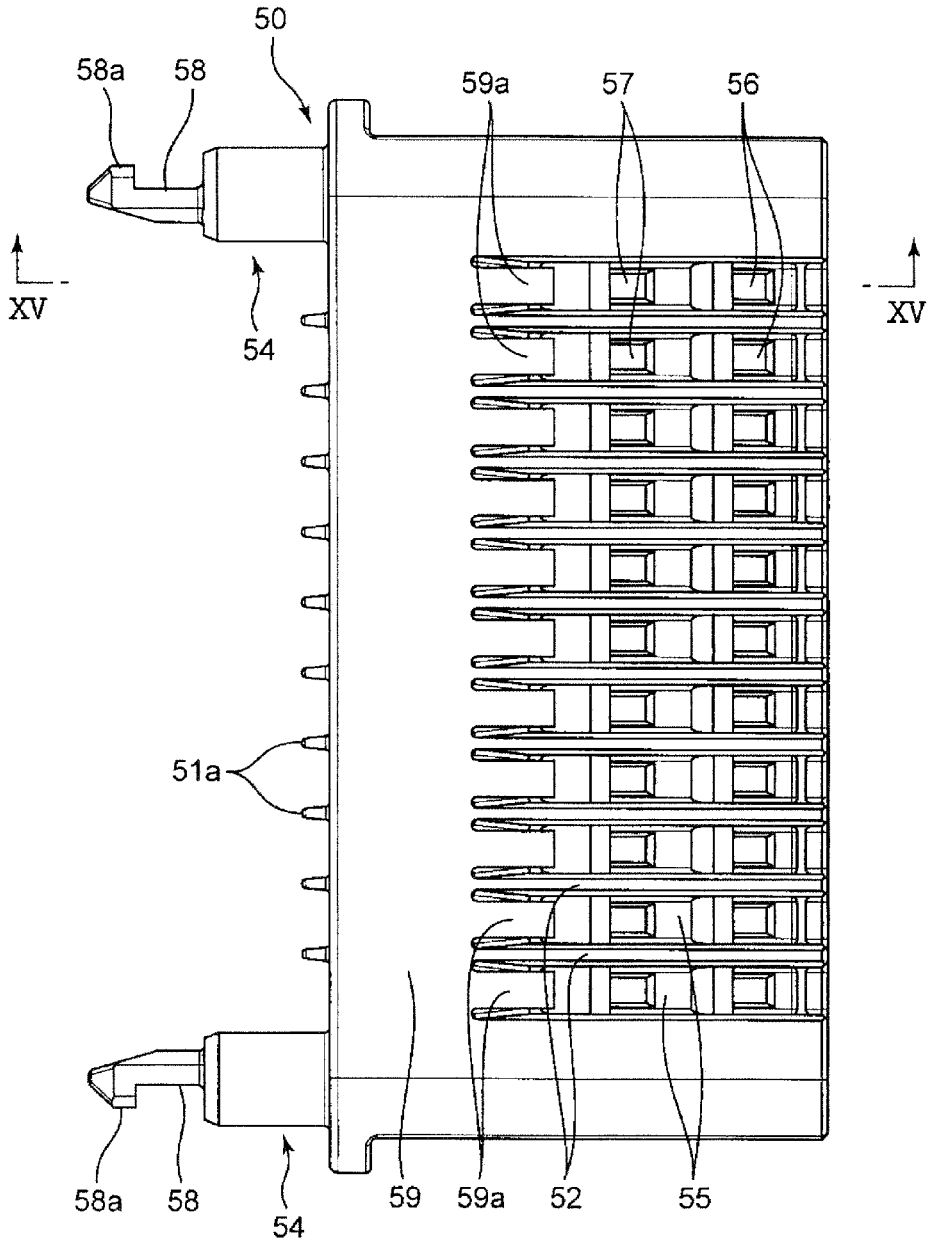
FIG. 14 is a plan view of the female terminal holding portion of FIG. 13.
Figure 15:
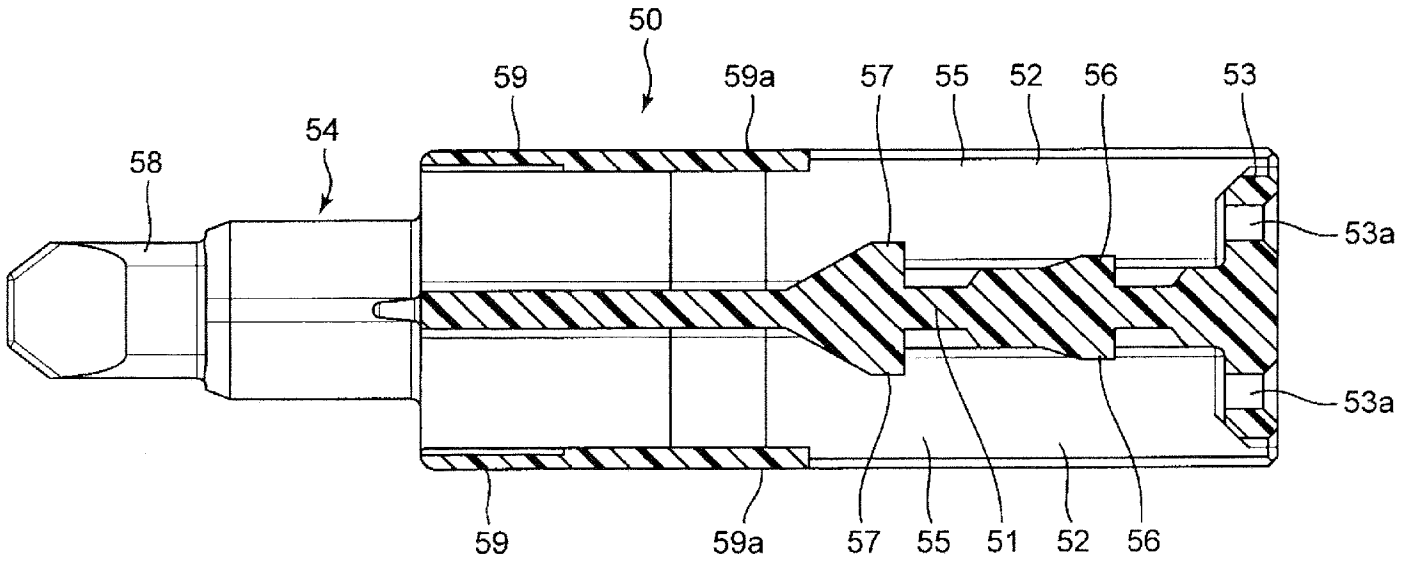
FIG. 15 is a section along XV-XV of FIG. 14.

The size of the open area of the cavity may be set appropriately according to specifications. For example, a part of each covering wall 59 may include flexible pieces 59*a* as shown in FIGS. 13 to 15. The flexible pieces 59*a* correspond to the respective female terminals 10, extend forward from a main part of the covering wall 59, and deform resiliently so that front ends of the flexible pieces 59*a* displace out (up or down) when the female terminals 10 are inserted. These deformations allow the female terminals 10 to be displaced out and move onto the respective female terminal locks 56, 57 while being held in contact with the flexible pieces 59*a* and enable the lift of the female terminals 10 to be suppressed by the flexible pieces 59*a* pressing the inserted female terminals 10 in from the outer side with resilient forces thereof. The flexible pieces 59*a* enable the covering walls 59 to restrain the female terminals 10 over a larger area and hold the female terminals 10 more stably.

The cavities 55 may be formed on only one side of the base wall 51 of the female terminal holding portion 50. In this case, the male terminal holder 40 may hold only one shorting member 30.

The present invention is not necessarily limited in its application to connectors having a fluid- or waterproof function. If watertightness is not required, the seal member 60 may be omitted and the male terminal holder 40 may not have the container shape as described above, i.e. may not integrally include the end wall 42 and the peripheral wall 44. For example, the male terminal holder 40 may include female terminal restraining portions for individually restraining the respective female terminals 10 set in the cavities 55.

The invention is not intended to completely exclude connectors with locking lances and a retainer for locking female terminals. For example, even if the front ends of the flexible pieces 59*a* shown in FIGS. 13 to 15 have an additional function as auxiliary locking lances in addition to a function as the female terminal locking portions, the simplification of the structure and the effect of reliably preventing the detachment of the female terminals can be combined as compared with conventional connectors in which locking lances mainly lock female terminals.

The invention also can be applied to a connector with male terminals mounted on ends of wires similar to female terminals, i.e. a connector for connecting wires, and a connector to be mounted on a circuit board in which male terminals are pin-shaped terminals to be mounted on the circuit board.

What is claimed is:

1. A connector, comprising:

first terminals to be mounted respectively to wires;

second terminals fittable to the respective first terminals;

a first terminal holder including a first terminal holding portion configured to hold the first terminals in a specified arrangement, the first terminal holder defining cavities configured to accommodate the respective first terminals and being open outward in a direction substantially perpendicular to a terminal fitting direction in which the first terminals and the second terminals are fit together, the first terminal holding portion including a base wall configured to support the first terminals from an inner side in a direction substantially perpendicular to the terminal fitting direction, first terminal locks projecting out from the base wall in the terminal fitting direction and configured to prevent separation of the first terminals in a direction away from the second terminals by contacting the respective first terminals accommodated in the cavities from a side opposite to the second terminals fit to the first terminals, and a covering wall configured to at least partly cover rear end parts of the cavities from an outer side, the first terminals being inserted into the cavities through an inner side of the covering wall from behind, the covering wall having flexible pieces corresponding to the respective first terminals and disposed to be deformed by the first terminals that move onto the first terminal locks and to exert resilient restoring forces for suppressing lift of the first terminals and pressing the inserted first terminals inward;

and a second terminal holder configured to collectively hold the second terminals and including a second terminal holding portion configured to hold the respective second terminals in an arrangement so that the second terminals are fittable to the respective first terminals and a first terminal restraining portion to be fit to the first terminal holding portion to restrain the first terminals held in the first terminal holding portion from an outer side in a state where the first terminals and the second terminals are fit.

2. The connector of claim 1, wherein the first terminal holder and the second terminal holder include one or more fitting locks to be engaged with each other to lock a fitted state of the first terminal holding portion and the first terminal restraining portion.

3. The connector of claim 1, wherein the first terminal locks have inclined surfaces inclined to enable the first terminals inserted in respective terminal insertion holes to move onto the first terminal locks along an inserting direction thereof.

4. The connector of claim 1, further comprising a unitary shorting member including a shorting portion extending in an arrangement direction of the second terminals and the second terminals projecting unitarily from the shorting portion, the second terminal holding portion holding at least the shorting portion of the shorting member so that the respective second terminals project from the shorting portion toward the first terminal restraining portion.

5. The connector of claim 4, wherein the second terminal holder includes an end wall and a peripheral wall extending from the end wall and at least partly surrounding an opening at a side opposite to the end wall, the end wall including the second terminal holding portion, and the peripheral wall includes the first terminal restraining portion.

6. The connector of claim 5, wherein the first terminal holder includes a seal located behind the first terminal holding portion, the seal being formed of a resilient material and having an outer peripheral surface to be held in close contact with an inner peripheral surface of the peripheral wall of the second terminal holder over substantially an entire periphery.

7. The connector of claim 6, wherein the seal includes inner peripheral surfaces respectively surrounding terminal insertion holes into which the respective first terminals and the wires connected to the first terminals are insertable, the inner peripheral surfaces being shaped to be held in close contact with outer peripheral surfaces of the wire inserted into the terminal insertion hole.

8. The connector of claim 6, the inner peripheral surface of the peripheral wall includes at least one pressing portion inclined to press the first terminal lifted out in the direction substantially perpendicular to the terminal fitting direction from a proper set position thereof with respect to the first terminal holding portion to the proper set position as the first terminal holding portion is inserted into the inside of the peripheral wall.

9. A connector, comprising:

first terminals to be mounted respectively to wires;

second terminals fittable to the respective first terminals;

a unitary shorting member including a shorting portion extending in an arrangement direction of the second terminals and the second terminals projecting unitarily from the shorting portion, the second terminal holding portion holding at least the shorting portion of the shorting member so that the respective second terminals project from the shorting portion toward the first terminal restraining portion;

a first terminal holder including a first terminal holding portion configured to hold the first terminals in a specified arrangement, the first terminal holding portion defining cavities configured to accommodate the respective first terminals and being open outward in a direction substantially perpendicular to a terminal fitting direction in which the first terminals and the second terminals are fit together and including first terminal locks configured to prevent separation of the first terminals in a direction away from the second terminals by contacting the respective first terminals accommodated in the cavities from a side opposite to the second terminals fit to the first terminals, and a seal formed of a resilient material positioned behind the first terminal holding portion, the seal having an outer peripheral surface; and a second terminal holder configured to collectively hold the second terminals, the second terminal holder having an end wall including a second terminal restraining portion and a peripheral wall extending from the end wall and at least partly surrounding an opening at a side opposite the end wall to define a second terminal holding portion configured to hold the respective second terminals in an arrangement so that the second terminals are fittable to the respective first terminals, the peripheral wall including a first terminal restraining portion to be fit to the first terminal holding portion to restrain the first terminals held in the first terminal holding portion from an outer side in a state where the first terminals and the second terminals are fit, and an inner peripheral surface of the peripheral wall held in close contact with the outer peripheral surface of the seal.

10. The connector of claim 9, wherein the first terminal holder and the second terminal holder include one or more fitting locks to be engaged with each other to lock a fitted state of the first terminal holding portion and the first terminal restraining portion.

11. The connector of claim 9, wherein the seal includes inner peripheral surfaces respectively surrounding terminal insertion holes into which the respective first terminals and the wires connected to the first terminals are insertable, the inner peripheral surfaces being shaped to be held in close contact with outer peripheral surfaces of the wire inserted into the terminal insertion hole.

12. The connector of claim 9, the inner peripheral surface of the peripheral wall includes at least one pressing portion.

13. The connector of claim 9, wherein the first terminal holding portion includes a base wall configured to support the first terminals from an inner side in a direction substantially perpendicular to the terminal fitting direction, and the first terminal locks project out from the base wall in the terminal fitting direction, the first terminal holding portion including a covering wall configured to at least partly cover rear end parts of the cavities from an outer side, and the first terminals being inserted into the cavities through an inner side of the covering wall from behind.

14. The connector of claim 13, wherein the covering wall has flexible pieces corresponding to the respective first terminals,the flexible pieces being disposed to be deformed by the first terminals that move onto the first terminal locks and exerting resilient restoring forces for suppressing lift of the first terminal and pressing the inserted first terminals inward.

15. The connector of claim 13, wherein the first terminal locks have inclined surfaces inclined to enable the first terminals inserted in respective terminal insertion holes to move onto the first terminal locks along an inserting direction thereof.

16. A connector, comprising:

first terminals to be mounted respectively to wires;

second terminals fittable to the respective first terminals;

a first terminal holder including a first terminal holding portion configured to hold the first terminals in a specified arrangement, the first terminal holding portion defining cavities configured to accommodate the respective first terminals and being open outward in a direction substantially perpendicular to a terminal fitting direction in which the first terminals and the second terminals are fit together and including first terminal locks configured to prevent separation of the first terminals in a direction away from the second terminals by contacting the respective first terminals accommodated in the cavities from a side opposite to the second terminals fit to the first terminals, and a seal formed of a resilient material positioned behind the first terminal holding portion, the seal having an outer peripheral surface; and a second terminal holder configured to collectively hold the second terminals, the second terminal holder having an end wall including a second terminal restraining portion and a peripheral wall extending from the end wall and at least partly surrounding an opening at a side opposite the end wall to define a second terminal holding portion configured to hold the respective second terminals in an arrangement so that the second terminals are fittable to the respective first terminals, the peripheral wall including a first terminal restraining portion to be fit to the first terminal holding portion to restrain the first terminals held in the first terminal holding portion from an outer side in a state where the first terminals and the second terminals are fit, and an inner peripheral surface of the peripheral wall held in close contact with the outer peripheral surface of the seal.

17. The connector of claim 16, wherein the first terminal holder and the second terminal holder include one or more fitting locks to be engaged with each other to lock a fitted state of the first terminal holding portion and the first terminal restraining portion.

18. The connector of claim 16, wherein the first terminal holding portion includes a base wall configured to support the first terminals from an inner side in a direction substantially perpendicular to the terminal fitting direction, and the first terminal locks project out from the base wall in the terminal fitting direction, the first terminal holding portion including a covering wall configured to at least partly cover rear end parts of the cavities from an outer side, and the first terminals being inserted into the cavities through an inner side of the covering wall from behind.

19. The connector of claim 18, wherein the first terminal locks have inclined surfaces inclined to enable the first terminals inserted in respective terminal insertion holes to move onto the first terminal locks along an inserting direction thereof.

20. The connector of claim 18, wherein the covering wall has flexible pieces corresponding to the respective first terminals, the flexible pieces being disposed to be deformed by the first terminals that move onto the first terminal locks and exerting resilient restoring forces for suppressing lift of the first terminals and pressing the inserted first terminals inward.

* * * * *